US005643538A

United States Patent [19]

Morlec et al.

[11] Patent Number: 5,643,538

[45] Date of Patent: Jul. 1, 1997

[54] HEAT TRANSFER AND THERMAL CLEANING ROTARY DEVICE APPLIED TO GASEOUS EFFLUENTS

[75] Inventors: Jean Morlec, Saint-Nazaire; Jacques Bourcier, 4, rue de l'Etoile du Matin, 44600 Saint-Nazaire, both of France

[73] Assignees: Institut Francais du Petrole, Rueil Malmaison; Jacques Bourcier, Saint-Nazaire, both of France

[21] Appl. No.: 445,958

[22] Filed: May 22, 1995

[30] Foreign Application Priority Data

May 24, 1994 [FR] France ..... 94 06282

[51] Int. Cl.[6] ..... F01N 3/10

[52] U.S. Cl. ..... 422/173; 422/171; 422/175; 422/177; 422/198; 422/206; 422/211; 165/5; 165/6; 165/8; 165/10; 431/5; 432/180

[58] Field of Search ..... 422/171, 173, 422/175, 177, 181, 190, 198, 200, 205–206, 218, 228, 211; 165/4–5, 6, 7–9, 10; 431/5; 432/180

[56] References Cited

U.S. PATENT DOCUMENTS

| | | | |
|---|---|---|---|
| 3,678,992 | 7/1972 | Daniels | 165/10 |
| 3,870,474 | 3/1975 | Houston | 422/171 |
| 4,231,418 | 11/1980 | Lagodmos | 165/4 |
| 5,145,652 | 9/1992 | Veser et al. | 165/8 |
| 5,362,449 | 11/1994 | Hedenhag | 422/173 |

FOREIGN PATENT DOCUMENTS

| | | |
|---|---|---|
| 3516831 | 11/1986 | Germany . |
| 266120 | 11/1987 | Japan . |

*Primary Examiner*—Robert J. Warden
*Assistant Examiner*—Hien Tran
*Attorney, Agent, or Firm*—Antonelli, Terry, Stout & Kraus, LLP

[57] ABSTRACT

A heat transfer device includes a ring having a vertical axis that can rotate inside a cage. The ring is inwardly provided with partitions. A permanent circulation of gaseous effluents is established on one hand between an effluent delivery pipe and a central zone via a first limited angular sector of the ring and on the other hand between the central zone and an effluent discharge pipe 6 via a second limited angular sector of the ring. The ring is charged with a mass of large heat exchange surface material and the device can be used for recovering positive or negative thermal energy. A thermal reactor of the catalytic bed type, for example, can be placed in the central zone for removing volatile organic compounds (VOC). The device may be used for catalytic or thermal oxidation of the organic compounds in gaseous effluents, for example.

9 Claims, 5 Drawing Sheets

HEAT TRANSFER AND THERMAL CLEANING ROTARY DEVICE APPLIED TO GASEOUS EFFLUENTS

FIELD OF THE INVENTION

The invention relates to a rotary transfer device for gaseous effluents, suited for working as a heat exchanger and, in a complementary manner, as a thermal effect cleaner.

The invention notably applies to heat exchange systems or to systems suited for cleaning air laden with substances such as volatile organic compounds (VOC), which can be oxidized and burnt off by thermal or catalytic incineration.

BACKGROUND OF THE INVENTION

Thermal action cleaning devices are generally very efficient and require little space. Their main drawback is their high energy consumption, an energy which is necessary for bringing the gases to be processed to the oxidation temperatures (850° C. to 1100° C.), a drawback which is decreased if the cleaning is performed in the presence of catalysts at much lower temperatures (200° C. to 450° C.).

For evident economic reasons, it is necessary, in all cases, to recover the greatest part possible of the heat accumulated by the effluents while passing through the thermal cleaner by means of thermal exchangers located downstream therefrom. In the case of an incineration in the presence of a catalytic bed, the effluents are heated prior to their incineration by passing into another thermal exchanger located upstream. The overall thermal efficiency depends on the effectiveness of the exchangers. In practice, autothermal incinerators are produced for cleaning gases laden with at least 0.7 g/m$^3$ of air.

A well-known heat exchange process consists in circulating the gases to be cleaned between two masses capable of taking up, of storing and of releasing the heat. By crossing the first mass, the effluents heat up until they reach a temperature close to that necessary to the oxidation of the polluting matters. They are then fed into a combustion furnace (with flame or flameless) or in a catalytic bed where they oxidize according to an exothermic reaction. The gases then cross the other mass to which they give up their calories prior to being discharged outside. The direction of flow is periodically inverted.

The main drawback of this periodic inversion is to disturb the processing regularity or its efficiency. Furthermore, it requires the intercalation of valves suited to the effluents pipes of often great section. If one chooses in fact to favour the cleaning quality, any mixing between the polluted and the cleaned gases must be prevented during the cycle inversion periods and the processing must therefore be stopped for a short time interval (some seconds in practice when each cycle lasts for several minutes). If the processing continuity is imposed, the mixing of the flows at the time of the inversions of direction during the intercycles, and therefore a momentary efficiency loss, must be accepted.

Another notable drawback of the heat exchange devices with periodic inversion is due to the fact that the preheating chamber, which is upstream from the furnace during a cycle, is thereafter downstream therefrom during the next cycle. The result of this is, on the one hand, a mixing of polluted and of cleaned effluents in this chamber during the intercycle and, on the other hand, a variation of the chamber temperature during the next cycle.

A well-known technique, notably used in thermal power plants, comprises using a rotary drum of vertical or horizontal axis. The efficiency obtained is relatively low (of the order of 60 to 75%) because the flows of unequal temperatures which exchange heat pass through the drum parallel to the axis thereof and are thus not properly separated from one another in the adjoining zones of circulation.

Another well-known heat exchange technique comprises using a crossed-flow thermal exchanger made with plates or tubes, in which the heated effluents give up their calories continuously to the gases to be cleaned. This technique is costly for average or high flow rates, because of the large heat exchange surfaces it implies and of the care to be exercised in order to obtain a perfect separation of the two flows.

SUMMARY OF THE INVENTION

The layout of the device according to the invention allows to perform thermal energy exchanges and possibly to clean thermally polluted effluents, while avoiding the drawbacks of the known techniques. The device comprises a housing or cage, a ring containing a charge of particulate solid materials selected because they offer a large heat exchange surface (silica, granite or lighter materials such as metallic alveolar structures or others, or cryogenic nodules for negative temperatures, etc.), which is located inside the cage. The ring is separated into several parts by an inner partitioning or, as the case may be, it is used as a support for a certain number of baskets. Motive means are used to drive the ring and the cage in a rotating motion with respect to one another about a vertical axis (either the ring rotates, the cage being stationary, or the ring is stationary and the cage rotates about it).

The device comprises at least one pipe for the delivery of effluents in the cage and at least one pipe for the discharge of effluents out of the cage. The ring comprises at least one first sector for communicating at any time the delivery pipe with the central part of the cage, where a first heat transfer is performed between the effluents and the charge in the ring. The ring also comprises a second sector for communicating at any time the central part of the cage with the discharge pipe, where a second heat transfer occurs between the effluents and the charge in the ring.

The rotation of the ring leads the mass of materials which has been heated (respectively cooled) by effluents towards the second sector where it heats (respectively cools) a second gaseous effluent.

The device can be used only as a heat exchanger and, in this case, it comprises a primary effluent circulation circuit including the delivery pipe and a pipe arranged in the central zone of the ring, this primary circuit communicating with a first source of effluents. It also comprises a secondary effluent circulation circuit including the discharge pipe, located on either side of the second sector, this secondary circuit communicating with a second source of effluents.

One of the two primary and secondary circuits is connected to a source of hot effluents, the other circuit being connected to a source of colder effluents.

The device can be used both as a heat exchanger and as an incinerator for polluted effluents. In this case, the delivery pipe is connected to a source of effluents containing polluting substances. The first sector and the second sector communicate directly with one another by means of the central part of the cage. A thermal reactor is located in this central part to burn the polluting substances in the effluents channelled by the first angular zone.

A catalytic bed thermal reactor is preferably used, which is selected to produce an exothermic reaction in the presence of the polluting substances.

The device can comprise additional means (burner, fuel injector) to raise, if need be, the temperature prevailing in the reactor, as well as other mechanical or chemical means for processing the mass in the ring.

The device according to the invention, provided with a rotary drum, affords many advantages:

It allows to fulfil, with a low volume, thermal treatment and exchange functions. Because of its compactness, pressure drops are highly reduced.

In the configuration where the hottest reaction zone is in the center of the cage, and the coldest zones on the periphery, a) the heat losses are low. Because of the cylindrical symmetry of the device and of the rotation of the inner ring, heat exchanges occur continuously, which requires no inversion of the direction of flow and allows a regular rate of the cleaned flow to be obtained. Possible direction inversions are anyway progressive, which promotes a high efficiency.

b) The high expansion consecutive to the temperature increase leads, as it is well-known, to an increase in the velocity of flow and consequently to pressure drops. It should be noted, in this respect, that the layout and the shape of the device allow to shorten considerably the portion of the circuit where the effluents are at a high temperature and therefore to decrease the energy expenses of the process facilities.

c) Owing to its compactness, the peripheral surface of the cage through which heat exchanges occur with the outside is relatively reduced, and heat losses are consequently lower and easier to minimize.

d) The hottest zone is in the center and the ring, which acts as an energy recuperator, is interposed between this zone and the periphery of the cage. The external temperature of the housing is therefore relatively low (less than 100° C. in practice), which simplifies the outer thermal insulation. A high concentration of the heat and an optimal recovery of the dissipations by the thermal mass located in the ring is thus obtained.

In practice, the device according to the invention, in its version with a catalytic bed reactor in the central zone, can work in an autothermal manner with effluents laden with 400 mg of VOC per $m^3$.

BRIEF DESCRIPTION OF THE DRAWINGS

Other features and advantages of the device according to the invention will be clear from reading the description hereafter given by way of non limitative examples, with reference to the accompanying drawings in which.

DESCRIPTION OF THE PREFERRED EMBODIMENTS

Figure 1:
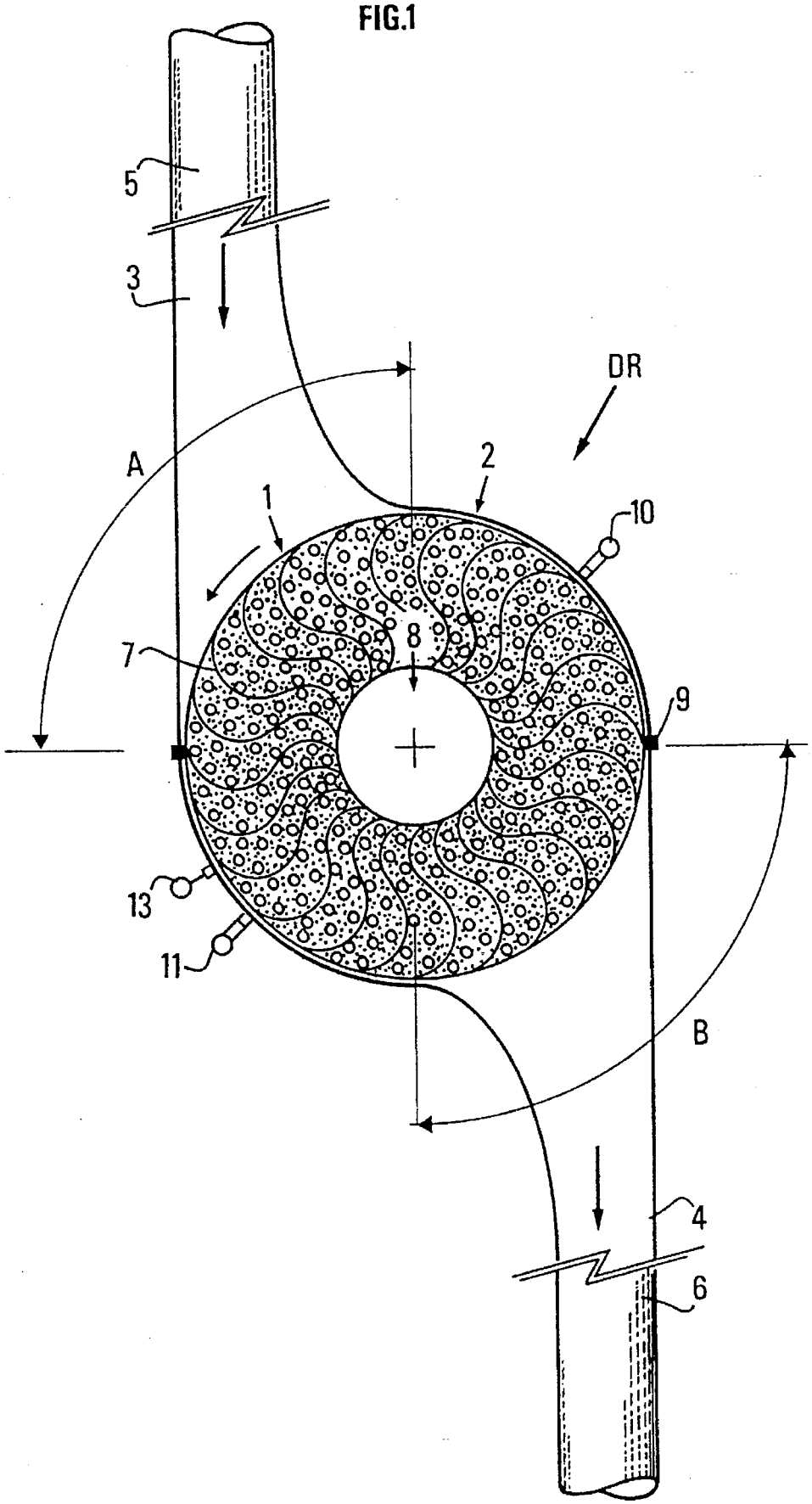
FIG. 1 shows a schematic sectional view of a first embodiment of the device, with a rotating ring.
Figure 2:
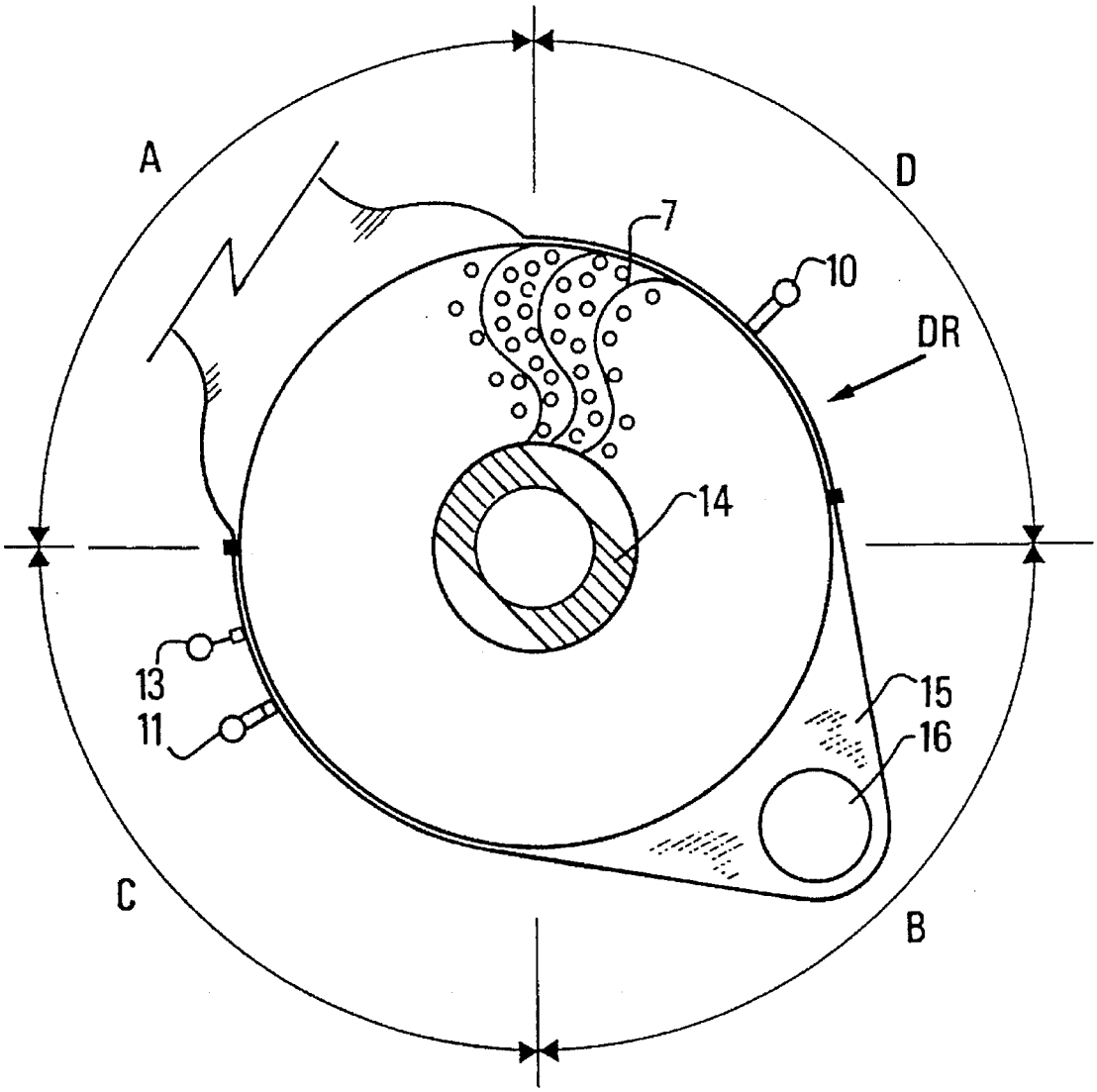
FIG. 2 shows a simplified schematic sectional view of a second embodiment of the device with a cage likely to rotate about the ring.
Figure 3:
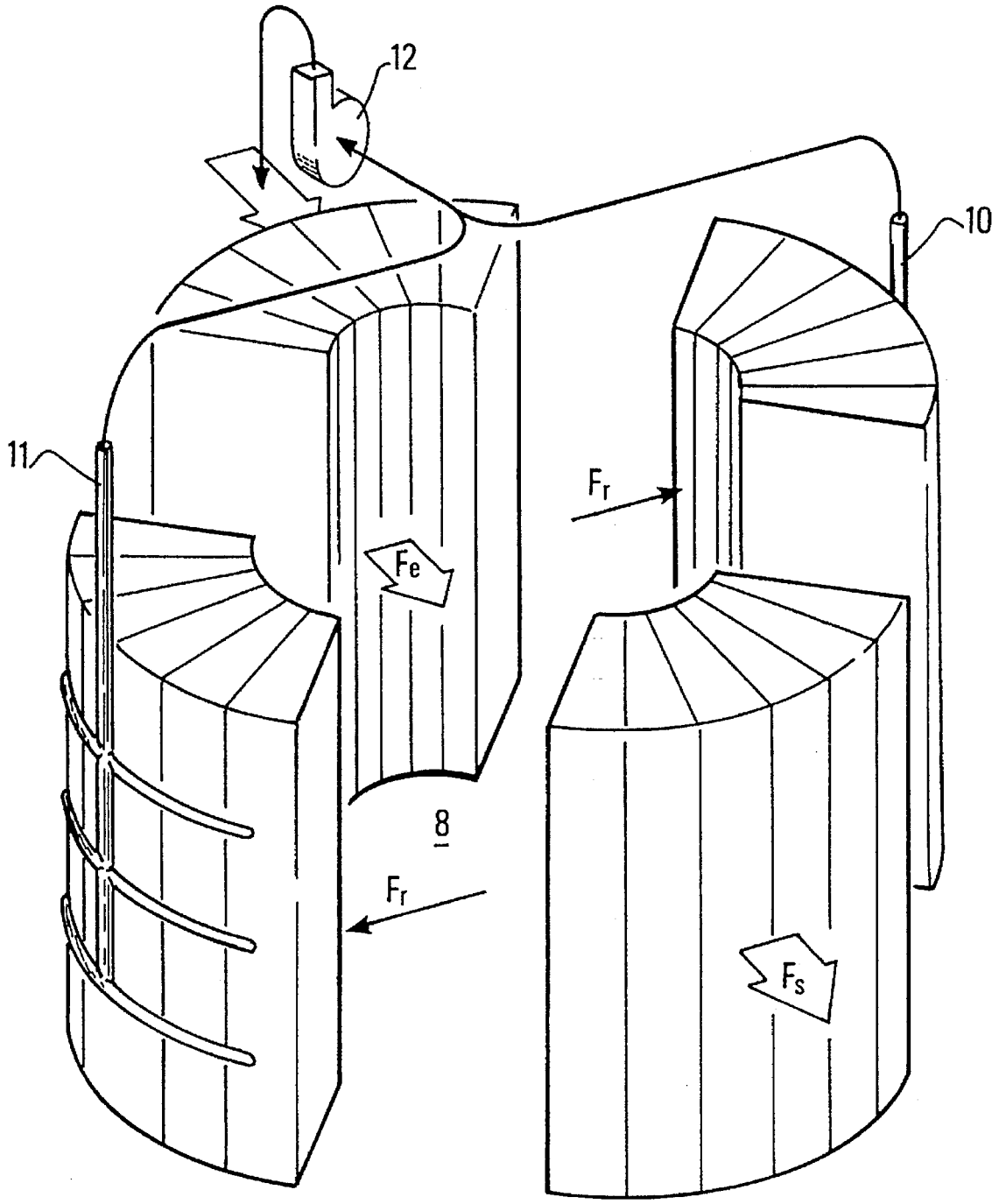
FIG. 3 shows an exploded view of the rotating drum to illustrate schematically the circulations of the effluents inside the rotary drum, FIG. 4 schematically shows an embodiment of the rotary drum used as a heat exchanger.

According to the embodiment of FIGS. 1, 2, 3, the device comprises a drum DR consisting of a ring 1 with a vertical axis located inside a metallic external housing or cage 2 of cylindrical shape, for example. The cage comprises a first arm 3 and a second arm 4 to which are connected, respectively, a pipe 5 for delivering the gaseous effluents to be cleaned, and a pipe 6 for discharging these effluents after they have been processed. The ring 1 is provided with an inner partitioning consisting of a set of evenly distributed straight or curved blades 7. A first angular sector A delimited by one or several blades and encompassed by an opening defined by arm 3 channels the effluents coming from pipe 5 towards the central zone 8 of the cage (flow Fe in FIG. 3). A second angular sector B also encompassed by an opening defined by arm 4 places the central zone 8 of the cage in communication with discharge pipe 6 (flow Fs in FIG. 3).

The ring can also be so laid-out that it is used as a support for a certain number of baskets (not shown).

An active mass M consisting of a large heat exchange surface material is distributed inside the ring (between the blades or in the baskets).

It may be ceramic or metallic balls, cutting chips or turnings, bulk or structured packing, an alveolar structure with regular or irregular cells such as honeycombs, metallic or ceramic knitted fabrics, etc. An alveolar structure such as that described in patent FR-2,564,037 filed by the applicant is advantageously used.

The charge of the ring can consist of pebbles. In the case of a negative heat transfer, cryogenic nodules are used.

Joints 9 are provided between the cage and the ring to form a vertical seal and to insulate from one another the two spaces upstream and downstream from the central zone or transit zone 8, so that all the inflowing effluents are practically channelled towards it. These joints 9 are so laid-out that the residual pressure drop between ring 1 and cage 2 is at least equal to the pressure drop undergone by the gases in the main circuit crossing the device through first and second angular sectors A, B.

Other joints (not shown) of the lip or of the brush seal type, of the circumferential hydraulic type with oil bath baffling, etc, are arranged so as to form a perimeter seal (horizontally).

The circular configuration of ring 1 and of cage 2, as well as the preferably curved shape of blades 7, are particularly well suited for withstanding high and frequent temperature variations, while providing a satisfactory guidance of the flows passing through the device.

Cage 2 and ring 1 are driven by motive means (not shown) in a slow rotating motion with respect to one another.

Cage 2 also comprises at least one opening in its lateral wall in each of the intermediate angular sectors C, D between sectors A and B, into which open pipes 10, 11 connected to suction means 12 (FIG. 3). The peripheral gas leaks between ring 1 and cage 2 are drawn in through pipes 10, 11 (recovery flow Fr of FIG. 3) and re-injected into delivery pipe 5 (incoming flow Fe).

In one of the two intermediate angular sectors C, D (FIG. 3), cage 2 can also comprise openings into which open one or several pipes 13 (FIGS. 1–2) to fulfil other functions. These may consist in injecting a chemical inhibitor to prevent a parasitic chemical reaction such as a polymerization, or the formation of plugs. It can be a mechanical action: suction or blowing in order to clean the ring charge, etc.

According to one embodiment, cage 2 is stationary (FIG. 1) and ring 1 is driven into rotation.

According to another embodiment (FIG. 2), ring 1 is stationary and cage 2 can rotate about its axis, driving pipes 5, 6 therewith. A selective-opening intermediate mask 14 is arranged in the central zone 8 of cage 2. This mask 14 rotates at the same time as cage 2 and is used for guiding the incoming flow (Fe in FIG. 3) towards the central zone 8 and the outgoing flow towards a convergence chamber 15 from which starts a chimney stack 16 so laid-out that it can follow the rotation of cage 2.

According to the mass of the ring, which depends on the nature of the large heat exchange surface charge M or on the applications and/or the volume of effluents to be processed, the embodiment of FIG. 1 or that of FIG. 2 is selected.

Figure 4:
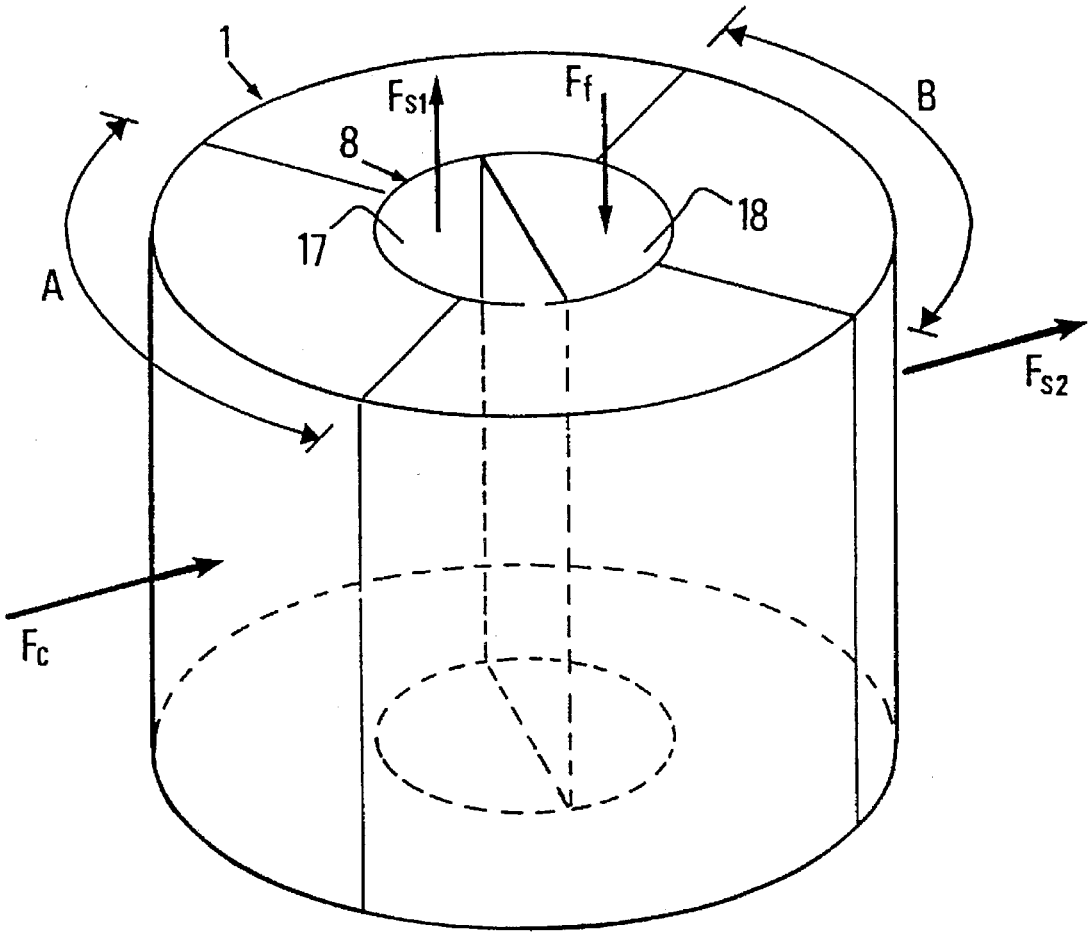

According to a first implementing mode (FIG. 4), the central zone 8 is used as a flow exchange zone for the discharge or the delivery of effluents.

A flow of hot effluents Fc is channelled through the angular sector A towards the central zone 8. The effluents give up their thermal energy to the charge M. In the central zone 8, they are channelled through a pipe 17 towards the outside (flow Fs1). Another pipe 18 is used to channel towards zone or sector B a flow of colder gases Ff. These cold gases, passing through the angular zone B, are then in contact with the particles which have been heated previously while passing through zone A and they flow out through pipe 6 at a higher temperature (flow Fs2).

The operation is identical for a heat transfer in the opposite direction. The flow of cold gases admitted through pipe 5 cools the mass M in the angular sector A of the ring. A hotter gas flow is allowed to pass through pipe 18 and, by flowing through the angular zone B, it is in contact with the particles which have been cooled while passing through zone A, and they flow out through pipe 6 at a lower temperature.

Figure 5:
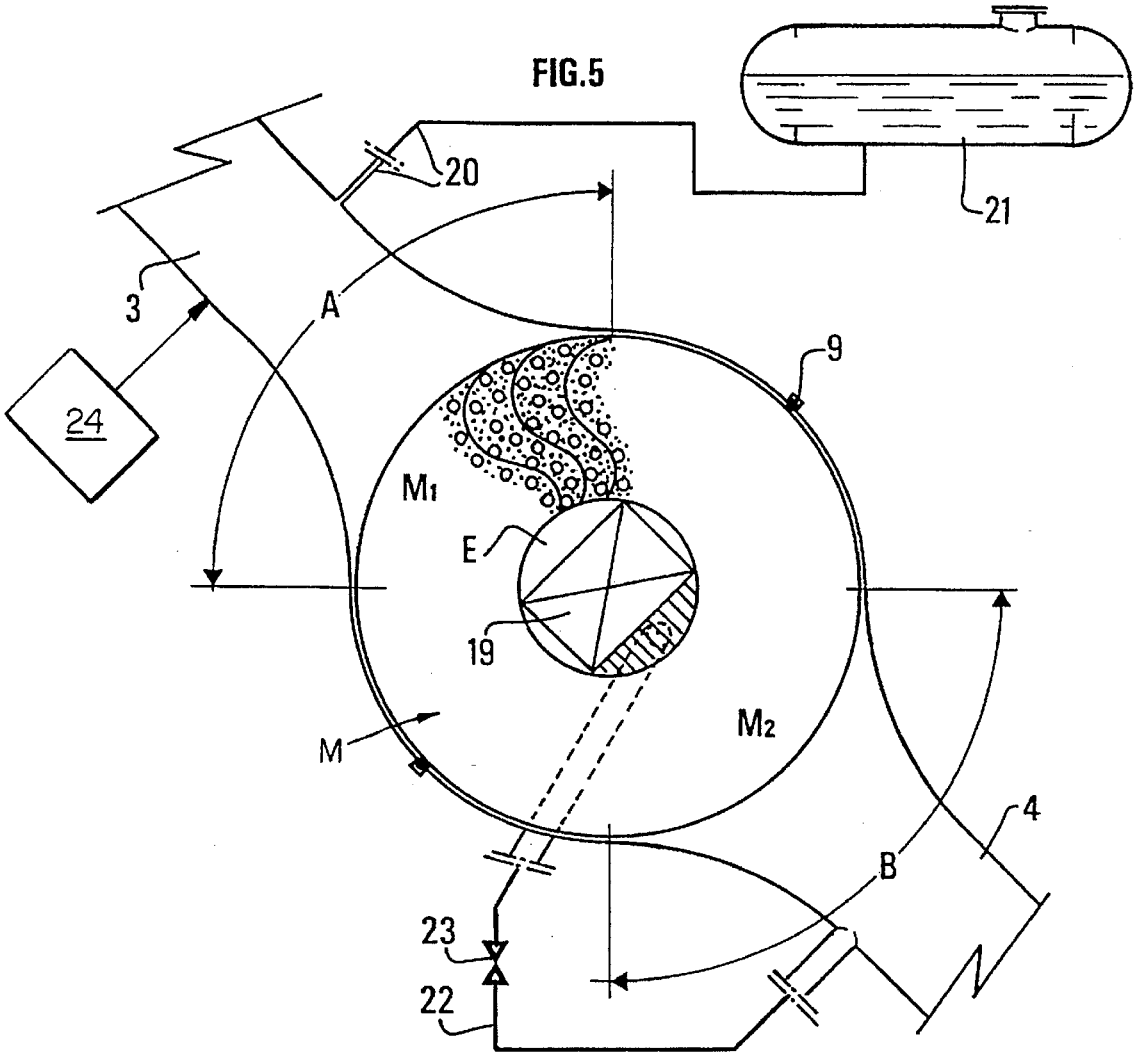
FIG. 5 shows an embodiment where the device is used for a mixed purpose as an incinerator of polluting substances in effluents, and as a heat exchanger, and FIG. 6 schematically shows the rotary drum and the central zone thereof.

According to the embodiment of FIG. 5, the device is used for a mixed purpose of heat exchange and of incineration of gaseous effluents laden with polluting substances such as VOC compounds for example. Ring 1 contains a charge M of large heat exchange surface as defined previously. The incineration of the polluting substances is performed in a reactor 19 located in the central part 8 of cage 2. Reactor 19 is preferably of the catalytic bed type. The effluents to be cleaned are flowed in at a relatively low temperature (200° C. to 400° C. for example). The reaction is exothermic and it is adjusted so as to release enough energy to compensate substantially for the calorific dissipation. A proportion of 0.4 mg of VOC per $m^3$ of effluents is enough for an autothermal running.

In some cases, if the polluting VOC compounds content is not sufficient, a natural gas or LPG (liquid propane gas) tank 21 is connected to the device by means of an injection tube 20 in order to improve the calorific value of the admitted effluents. A bypass circuit 22 controlled by a valve 23 allows part of the hot gases to be discharged without passing through the exchanger. A burner 24 can be arranged upstream from the drum DR to heat the inflowing effluents on starting if need be, so as to reach an autothermal working point.

After flowing through reactor 19, the polluting compounds (VOC) are converted through the reaction into various combustion products: $CO_2$, $H_2O$, $N_2$ mainly, $SO_x$ and $NO_x$ in the state of traces.

The gases at high temperature coming from reactor 19 flow through the part M2 of the charge M located in the angular zone B of the ring and give up a large part of their calories thereto. The rotation of ring 1 in relation to cage 2 progressively brings the heated elements towards the angular zone A where they can also give up part of the accumulated calorific energy to the gases flowing in through delivery pipe 5.

The desired oxidation can also be obtained by placing, in the central zone of the ring, direct heating means of a known type allowing the effluents to be brought to a temperature of the order of 850° C. to 1100° C.

Example of use

Figure 6:
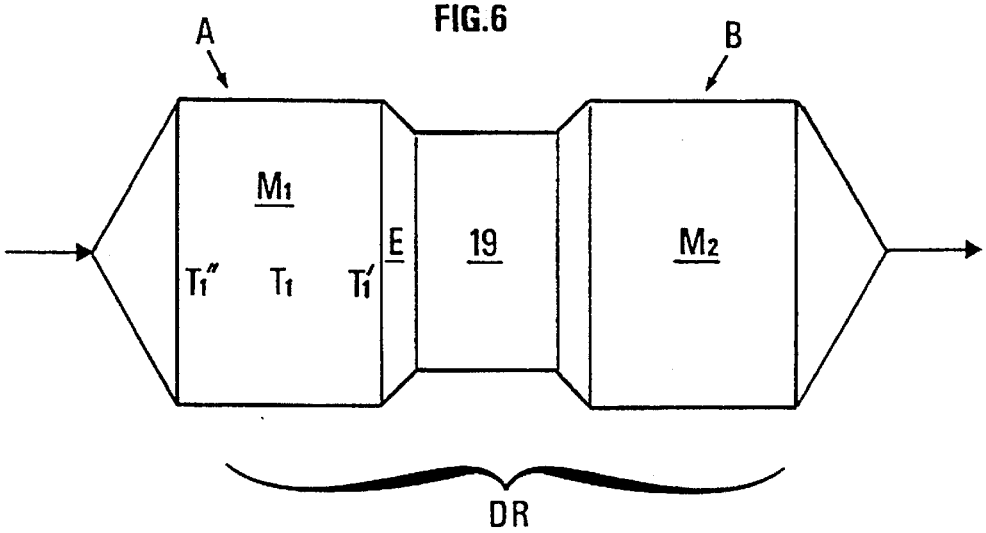

The polluted air (or the reject to be incinerated) is sent (FIG. 6) onto the charge M1 in the angular sector A of the device, a hot zone where an ascending temperature gradient is established from the outer part (temperature T"1) to the inner part (temperature T'1) around an average temperature T1 (T'1>T1>T"1). The reheated air passes into the distribution zone E. If the temperature of the reheated air is lower than the catalytic activity temperature, make-up heat can be provided in this zone E. The air then passes through the catalyst in reactor 19 and the polluting VOC compounds are converted into combustion products ($CO_2$, $H_2O$, $SO_2$, $N_2$ and $NO_x$). The gases thereafter flow through the charge M2 of the angular sector B which they heat up to a filling mass outlet temperature equal to T2, very close to T'1, apart from the heat losses.

This application of the device is particularly advantageous:

- when one does not wish to recover the polluting VOC compounds,
- when the VOC compounds content is high enough to avoid a high heat makeup in E, the catalytic incineration heat balancing the thermal losses. This limit, with the system described above, is of the order of 400 mg/$m^3$ of hydrocarbons.

We claim:

1. A thermal cleaning rotary transfer device for processing incoming gaseous effluents laden with polluting substances which comprises a vertically disposed cage provided with a central zone, a ring containing a charge of solid materials having a heat exchange surface surrounding the central zone and being arranged vertically inside the cage, the ring and the cage being rotated with respect to one another, at least one pipe for delivering the incoming gaseous effluents to the cage, at least one discharge pipe for discharging cleaned effluents from the cage, and a catalytic reactor for burning the polluting substances in the incoming gaseous effluents, said reactor being disposed in the central zone and containing a catalyst selected to produce an exothermic reaction in the presence of the polluting substances, the ring comprising at least a first sector through which the incoming effluents are radially directed through the solid materials to the central zone and where a first heat transfer occurs between said effluents and said solid materials in the ring, and at least a second sector through which the cleaned effluents are radially directed from the central zone to the at least one discharge pipe and where, a second heat transfer occurs between said effluents and the solid materials in the ring.

2. A device according to claim 1 further comprising means for raising the temperature prevailing in the reactor to reach autothermal conditions.

3. A device according to claim 2, wherein the means for raising the temperature comprises an auxiliary fuel injection means.

4. A device according to claim 1 further comprising means for drawing effluents into at least one intermediate sector of the ring between the first and second sectors.

5. A device according to claim 1 further comprising duct means for conveying fluids for cleaning said charge of solid materials.

6. A device according to claim 1 further comprising duct means for communicating with the inside of the ring and means for injecting chemical substances into said duct means.

7. A device according to claim 1 further comprising a plurality of inner radial partitioning blades for separating the charge into several annular zones.

8. A device according to claim 1, wherein the cage is stationary and the ring rotates.

9. A device according to claim 1, wherein the ring is stationary and the cage with delivery and discharge pipes fastened to the cage rotates.

* * * * *